US005826746A

United States Patent [19]

Ash, Jr.

[11] Patent Number: 5,826,746

[45] Date of Patent: Oct. 27, 1998

[54] BACKPACK DISPENSING SYSTEM FOR PACKAGED GOODS

[76] Inventor: William O. Ash, Jr., 2537 S. Gessner, No. 216, Houston, Tex. 77063

[21] Appl. No.: 819,638

[22] Filed: Mar. 17, 1997

Related U.S. Application Data

[63] Continuation-in-part of Ser. No. 409,741, Mar. 23, 1995, Pat. No. 5,611,457.

[51] Int. Cl.[6] ..... A01C 00/00

[52] U.S. Cl. ..... 221/185; 221/312 C; 221/309; 221/307; 221/281; 224/153; 40/538; 40/586

[58] Field of Search ..... 221/185, 307, 221/306, 303, 309, 281, 98, 97, 150 R, 312 C; 224/153, 196, 237; 40/538, 586, 611

[56] References Cited

U.S. PATENT DOCUMENTS

| | | | |
|---|---|---|---|
| 2,704,627 | 3/1955 | Brulin et al. | 221/185 |
| 4,420,103 | 12/1983 | Douglas | 224/153 |
| 5,086,948 | 2/1992 | Slusarz | 221/185 |
| 5,095,718 | 3/1992 | Ormond et al. | 224/153 |
| 5,370,287 | 12/1994 | Cormier | 224/153 |
| 5,611,457 | 3/1997 | Ash, Jr. | 221/185 |

FOREIGN PATENT DOCUMENTS

| | | | |
|---|---|---|---|
| 460460 | 1/1937 | United Kingdom | 221/307 |

OTHER PUBLICATIONS

Rocket Man Inc., New Product Release "Canpak", p. 134, Oct. 1995 issue, Beverage World Magazine.

Rocket Man Inc., New Product Release "Canpak", p. 50, Nov. 1995 issue, Nightclub and Bar Magazine.

*Primary Examiner*—William E. Terrell

*Assistant Examiner*—Khoi H. Tran

*Attorney, Agent, or Firm*—Kenneth A. Roddy

[57] ABSTRACT

A backpack carried on the back of a vendor for transporting and dispensing packaged goods, such as food products or other merchandise. The backpack has a back wall, front wall, opposed side walls, a top closure, and a bottom wall defining a generally rectangular storage compartment. The backpack has at least one access opening at a lower end which is accessible to the hand of the vendor wearing the backpack. A plurality of packaged goods are supported in a vertically descendable disposition by a support member or receptacle installed in the storage compartment which has a lower portion disposed adjacent to the access opening and is configured to support the lowermost one of the packaged goods adjacent to the access opening such that it can be manually removed by the vendor while the backpack is being worn. In a preferred embodiment, the lower portion of the opposed side walls of the backpack extend laterally outward from the storage compartment to define laterally opposed side extensions, and the back wall has a pair of laterally opposed access openings one in each side extension accessible to either hand of the person wearing the backpack by reaching rearwardly to manually withdraw the lowermost one of the packaged goods with either hand. The walls may be thermally insulated to maintain the temperature of packaged food products. A hollow shell may be installed on the exterior of the backpack which is configured to resemble the shape of the goods contained within the backpack.

17 Claims, 10 Drawing Sheets

BACKPACK DISPENSING SYSTEM FOR PACKAGED GOODS

CROSS REFERENCE TO RELATED APPLICATION

This application is a Continuation-In-Part of U.S. patent application Ser. No. 08/409,741 filed Mar. 23, 1995 now U.S. Pat. No. 5,611,457.

BACKGROUND OF THE INVENTION

1. Field of the Invention

This invention relates generally to portable dispensers carried on the back of a person, and more particularly to a backpack carried on the back of a vendor for transporting and dispensing packaged goods, such as food or other merchandise, that has a generally rectangular storage compartment which holds a plurality of packaged goods in a vertical descendable disposition and at least one access opening at a lower end of the backpack in a position accessible to the hand of the person wearing the backpack.

2. Brief Description of the Prior Art

Portable coolers and backpack coolers which are adapted to contain a number of individual beverage cans are known in the art.

Brulin et al, U.S. Pat. No. 2,704,627 discloses a rigid box-like beverage can dispensing device which has a outlet opening at the bottom of one end wall and a pair of leaf springs riveted at their upper ends to the inner side of the end wall to retain the cans in the box-like housing. The device has a hinged door on one side and an inclined platform positioned in the housing that extends downwardly to the outlet opening. The Brulin et al device is not worn on the back of the vendor, and the opening would be difficult or impossible to reach by a person wearing the backpack.

Calton, U.S. Pat. No. 4,673,117 discloses a backpack cooler that also serves as a seat which utilizes an insulated rigid foam core that is received inside a cloth sheath or jacket and has a rigid reinforcing liner which defines a well to hold two stacked six packs of 12 ounce can containers. The cloth jacket is retained on the cooler body by a retainer cord, and a pair of shoulder straps fasten to the cloth jacket. The entire structure is strong enough to support the weight of a person, so that it doubles as a seat. The jacket also has an uninsulated accessory pouch. There is no provision for dispensing the cans other than opening the lid of the foam core in the manner of a conventional insulated cooler.

Leslie, U.S. Pat. No. 4,721,237 discloses a portable cooler that may be carried in back-pack style which stores and automatically dispenses a number of cans of beverage. The cooler is comprised of a box-like chamber having self-supporting thermally insulative material on its exterior surfaces. One or more removable coolant-confining containers are positioned within the chamber, each having a serpentine contour of horizontally elongated recesses adapted to hold beverage cans and permit their vertical descent to a door positioned adjacent the bottom of the chamber. The chamber is held within a snug-fitting fabric carrying jacket having a zippered lid and closure for the door, and carrying straps. The door is not accessible to the hand of the person wearing the backpack.

Ormond et al, U.S. Pat. No. 5,095,718 discloses a box-like refrigeration case formed of thermally insulating material having shoulder straps which is worn on the back and contains a plurality of cans of beverages which are supported on horizontally spaced thermoplastic coated cooling units shaped to surround the cans. The cans are contained entirely within the rectangular storage compartment and the device has a series of horizontal fabric doors or flaps on the front surface adjacent the horizontal rows of cans. There is no suggestion in Ormond et al of providing access to the cans by a person wearing the backpack, and it would be impossible for a person wearing the Ormond et al device to reach a can while the device is being worn.

Other backpack dispensers which are adapted to contain various types of articles are also known in the art.

Slusarz, U.S. Pat. No. 5,086,948 discloses a tennis ball pack apparatus having an adjustable waist belt and back pad. The Slusarz device has access openings which are slightly smaller than the tennis balls in the corners of a rectangular storage compartment and supports the balls horizontally on flexible wire members such that the lowermost tennis balls are retained within the housing approximately flush with the side walls.

The British Patent 460,460 to Harwood et al discloses a small container with the lower outer corner of each compartment cut away to form an aperture through which the lowermost article may be gripped between the finger and thumb and the outer wall of each compartment is slit along the edges from the aperture to form a flexible tongue bearing against the lowermost article to retain the lowermost article within the housing approximately flush with the inner surface of the end wall.

The present invention is distinguished over the prior art in general, and these patents in particular, by a backpack carried on the back of a vendor for transporting and dispensing packaged goods, such as food products or other merchandise. The backpack has a back wall, front wall, opposed side walls, a top closure, and a bottom wall defining a generally rectangular storage compartment. The backpack has at least one access opening at a lower end which is accessible to the hand of the vendor wearing the backpack. A plurality of packaged goods are supported in a vertically descendable disposition by a support member or receptacle installed in the storage compartment which has a lower portion disposed adjacent to the access opening and is configured to support the lowermost one of the packaged goods adjacent to the access opening such that it can be manually removed by the vendor while the backpack is being worn. In a preferred embodiment, the lower portion of the opposed side walls of the backpack extend laterally outward from the storage compartment to define laterally opposed side extensions, and the back wall has a pair of laterally opposed access openings one in each side extension accessible to either hand of the person wearing the backpack by reaching rearwardly to manually withdraw the lowermost one of the packaged goods with either hand. The walls may be thermally insulated to maintain the temperature of packaged food products. A hollow shell may be installed on the exterior of the backpack which is configured to resemble the shape of the goods contained within the backpack.

SUMMARY OF THE INVENTION

It is therefore an object of this invention to provide a backpack dispensink13H system which is suitable for containing and dispensing a number of individual packaged products, such as food products or other merchandise.

It is another object of the present invention to provide a backpack dispensing system which is self contained and suitable to be carried on the back of a vendor.

Another object of this invention it to provide a backpack dispenser having a thermally insulated storage compartment for containing a plurality of packaged food products which will allow the food products to be served at optimum temperatures.

Another object of this invention is to provide a backpack dispenser having a support member or replaceable receptacle configured to hold a plurality of packaged goods in a vertical descendable disposition.

Another object of this invention is to provide a backpack dispenser having at least one access opening disposed at a lower end of the backpack which is accessible to the hand of the person wearing the backpack to allow packaged goods contained therein to be quickly and easily withdrawn by reaching rearwardly while wearing the backpack.

Another object of this invention is to provide a backpack dispenser having a pair of laterally opposed access openings in a lower portion thereof which are accessible to either hand of the person wearing the backpack to allow packaged goods contained therein to be quickly and easilywithdrawn by reaching rearwardly with either hand while wearing the backpack.

Another object of this invention is to provide a backpack dispenser which has a storage pouch for containing new or used packaging materials and other articles.

Another object of this invention is to provide a backpack dispensing system having one or more panels on the exterior of the backpack which are imprinted with a picture or other advertising indicia to represent the type of goods contained within the backpack.

A further object of this invention is to provide a backpack beverage dispensing system having a hollow shell installed on the exterior of the backpack which is configured to resemble the appearance or identity of the type of goods contained within the backpack.

A still further object of this invention is to provide a portable beverage dispensing system which is aesthetically pleasing, simple in construction, economical to manufacture, and rugged and durable in use.

Other objects of the invention will become apparent from time to time throughout the specification and claims as hereinafter related.

The above noted objects and other objects of the invention are accomplished by a backpack carried on the back of of a vendor for transporting and dispensing packaged goods, such as food products or other merchandise. The backpack has a back wall, front wall, opposed side walls, a top closure, and a bottom wall defining a generally rectangular storage compartment. The backpack has at least one access opening at a lower end which is accessible to the hand of the vendor wearing the backpack. A plurality of packaged goods are supported in a vertically descendable disposition by a support member or receptacle installed in the storage compartment which has a lower portion disposed adjacent to the access opening and is configured to support the lowermost one of the packaged goods adjacent to the access opening such that it can be manually removed by the vendor while the backpack is being worn. In a preferred embodiment, the lower portion of the opposed side walls of the backpack extend laterally outward from the storage compartment to define laterally opposed side extensions, and the back wall has a pair of laterally opposed access openings one in each side extension accessible to either hand of the person wearing the backpack by reaching rearwardly to manually withdraw the lowermost one of the packaged goods with either hand. The walls may be thermally insulated to maintain the temperature of packaged food products. A hollow shell may be installed on the exterior of the backpack which is configured to resemble the shape of the goods contained within the backpack.

DESCRIPTION OF THE PREFERRED EMBODIMENT

Figure 1:
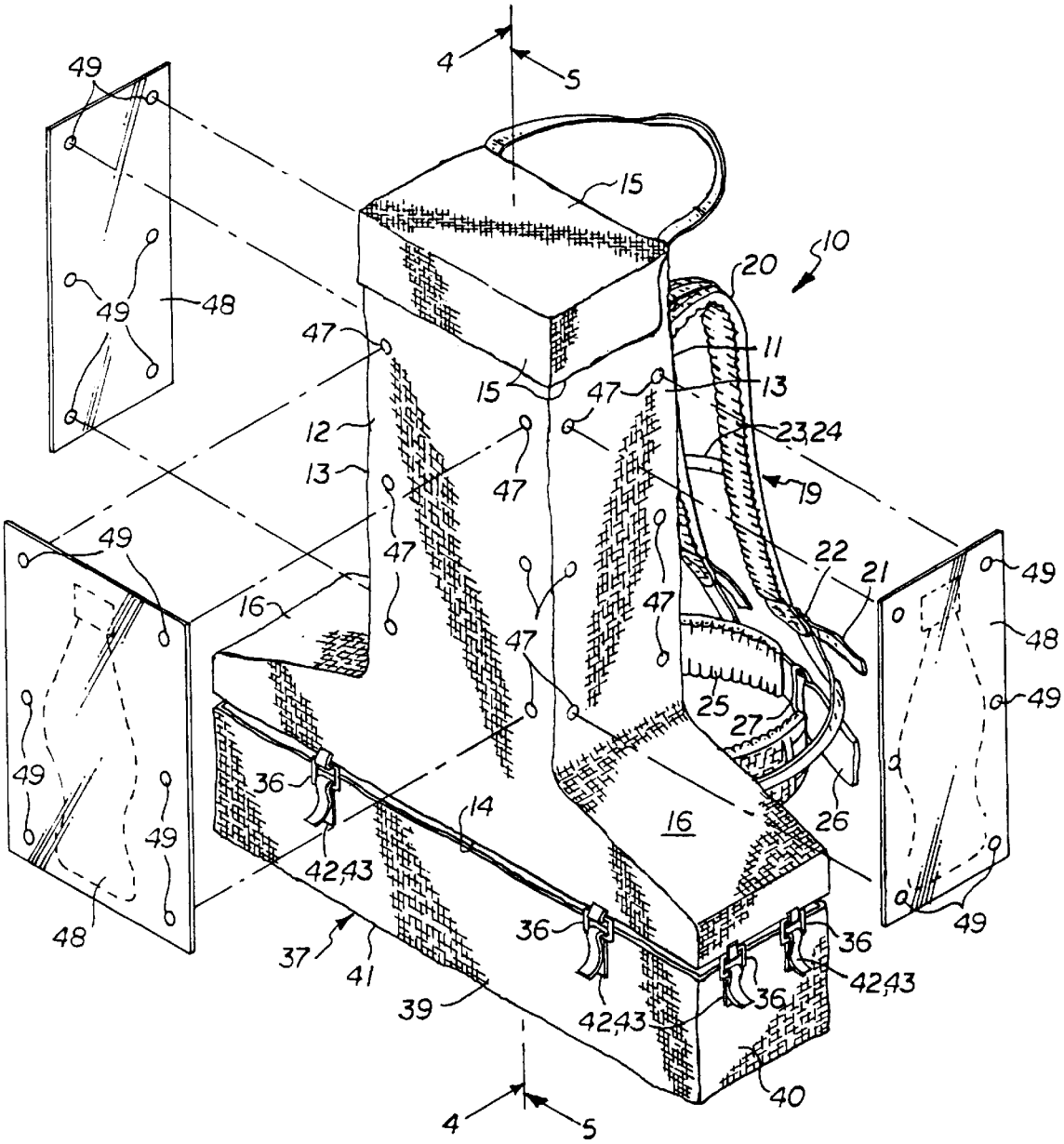
FIG. 1 is a perspective view of a backpack in accordance with the present invention.
Figure 2:
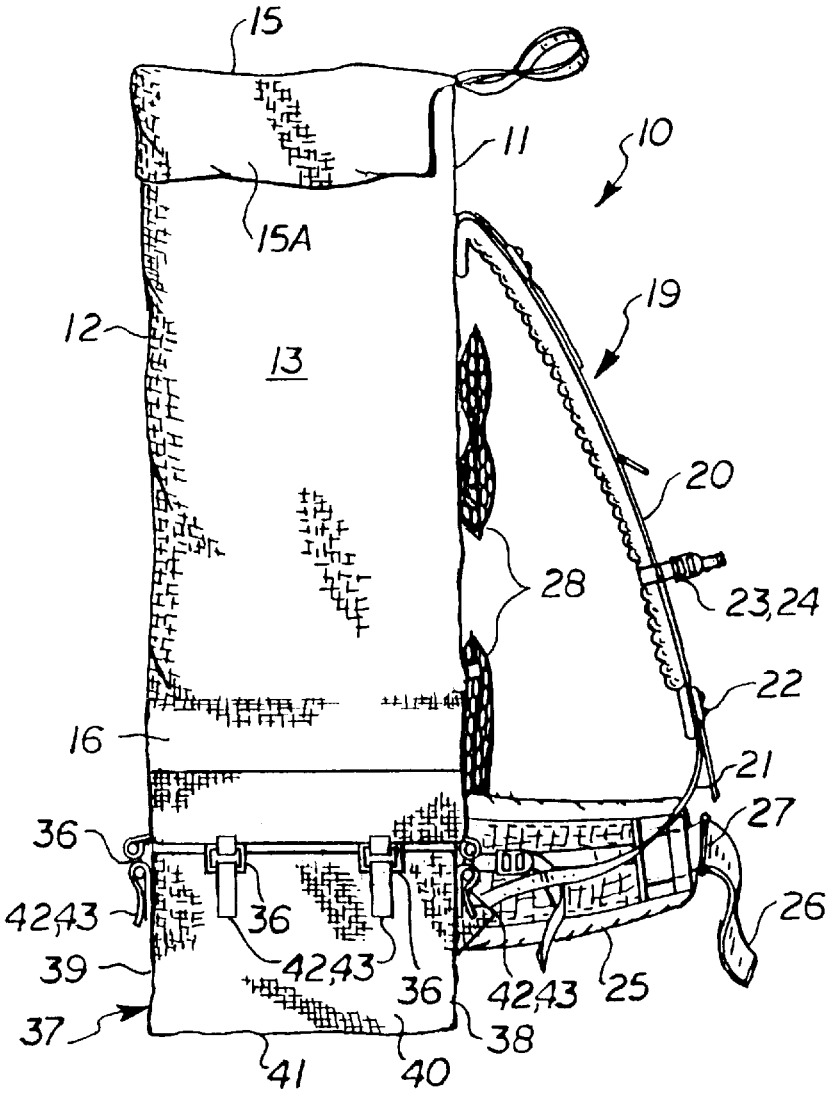
FIG. 2 is a side elevation of the backpack.
Figure 3:
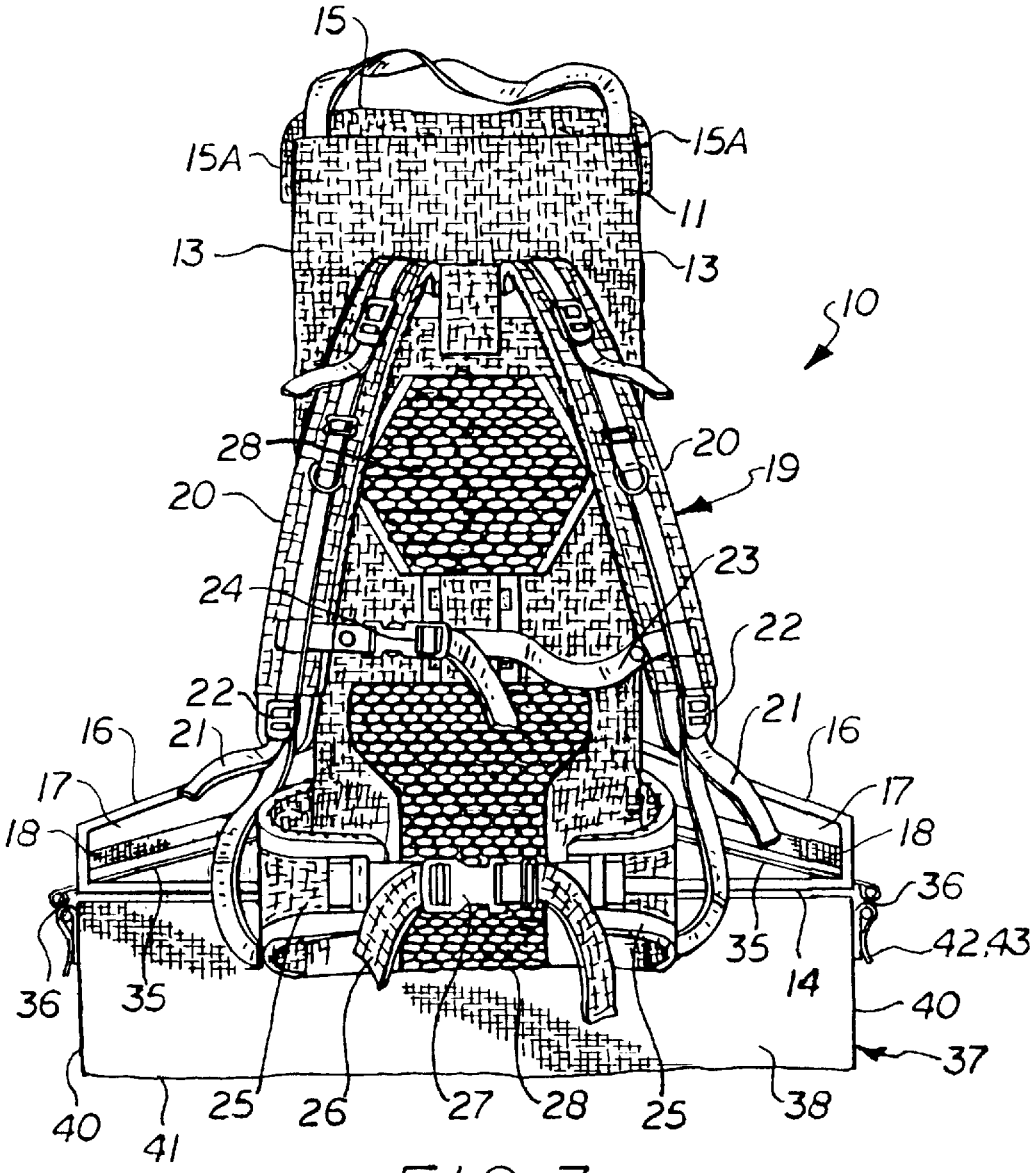
FIG. 3 is a rear elevation of the backpack.
Figure 4:
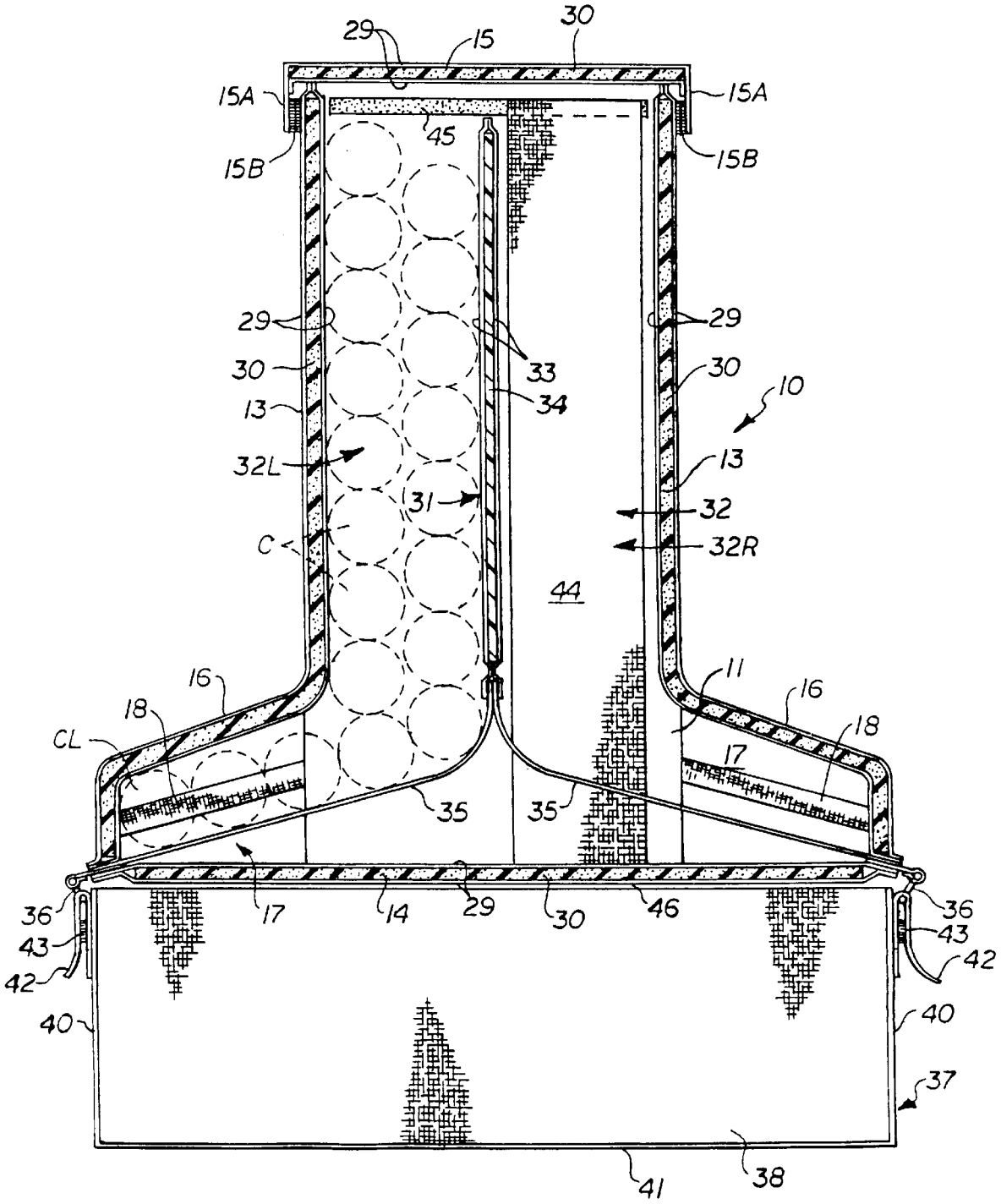
FIG. 4 is a longitudinal cross section through the backpack taken along line 4—4 of FIG. 1, showing the interior of the backpack having a support member installed therein.

Referring to the drawings by numerals of reference, there is shown in FIGS. 1, 2, and 3, a backpack 10 particularly suited for transporting and dispensing a number of individual packaged goods which is adapted to be carried on the back of a vendor. The backpack 10 has a back wall 11, a front wall 12, opposed side walls 13, a bottom wall 14, and a hinged top closure 15 defining a generally rectangular interior compartment. The lower portion of the backpack just above the bottom wall 14 extends laterally outward and downward from the opposed side walls 12 to define laterally opposed generally triangular portions 16. As best seen in FIGS. 3 and 4, the triangular portions 16 of the back wall 11 are provided with access openings 17. An elastic strap 18 may be secured across each access opening 17.

A shoulder harness 19 is secured to the backpack 10 and has a pair of padded shoulder straps 20, each of which are connected to the backpack by an adjustment strap 21 and adjustment buckle 22 and are interconnected by a transverse chest strap 23 and adjustment buckle 24 to permit proper adjustment of the shoulder straps about the shoulders and chest of the vendor. The backpack 10 is also provided with a pair of padded waist belt sections 25 interconnected by an adjustment strap 26 and adjustment buckle 27 for encircling the waist of the vendor. One or more back pads 28 may also be secured to the back wall 11 of the backpack 10 to provide added comfort to the wearer.

Figure 5:
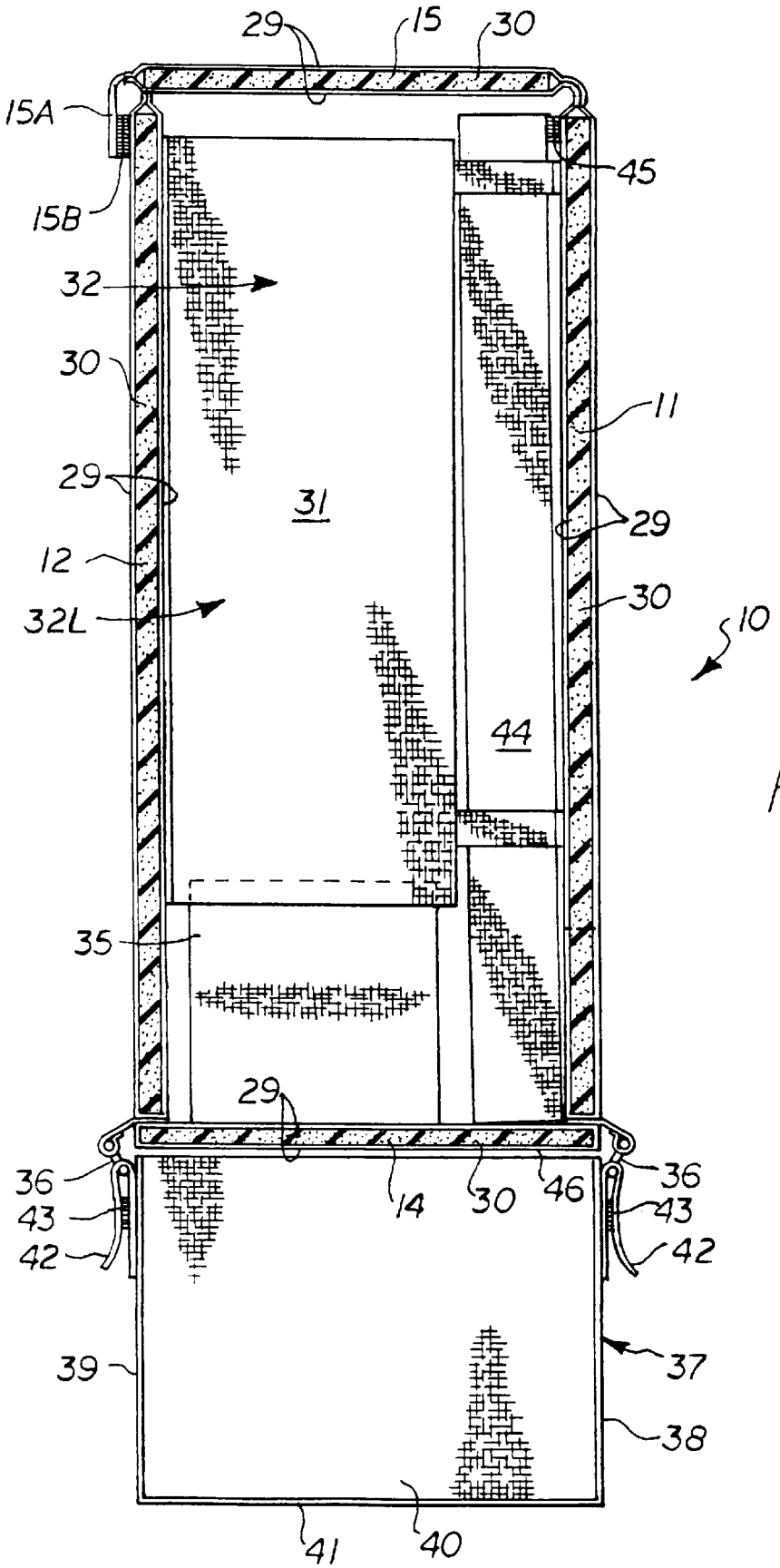
FIG. 5 is a longitudinal cross section through the backpack taken along line 5—5 of FIG. 1.

Referring now to FIGS. 4 and 5, the backpack 10 is shown in longitudinal cross section, however the previously shown and described shoulder harness, straps, waist belt, and buckles are not shown to avoid confusion. As seen in FIGS. 4 and 5, the back wall 11, front wall 12, opposed side walls 13, bottom wall 14, and hinged top closure 15 are formed of two plies of a suitable flexible fabric material 29, such as nylon or canvas, between which a semi-rigid rectangular piece of elastomeric material 30 such as foam plastic or foam rubber is disposed. In a preferred embodiment for containing food products, the rectangular piece of material 30 is a thermally insulating material. The back wall 11 and bottom wall 14 may also be provided with one or more rectangular rigid panels or strips (not shown) vertically disposed between the plies of fabric material to stiffen and reinforce the back and bottom walls. The top closure 15 is hinged along one edge to the back wall 11 and has a depending skirt 15A on the front and side edges. The top closure 15 is releasably secured to the open top end of the compartment by mating hook and loop fasteners 15B installed on the underside of the skirt 15A and exterior of the upper end of the backpack 10.

In the embodiment of FIGS. 4 and 5, a vertically extending rectangular divider 31 is attached perpendicularly between the front and back walls 12 and 11, respectively, of the backpack 10 to divide the interior compartment 32 into right and left compartments 32R and 32L. The rectangular divider 31 is formed of two plies of a suitable flexible fabric material 33 between which a rigid rectangular panel 34 or semi-rigid rectangular piece of elastomeric material such as foam plastic or foam rubber is disposed. In a preferred embodiment for containing food products, the rectangular panel is 34 is a thermally insulating material.

A pair of generally rectangular panels 35 are secured at their upper ends to the lower portion of the divider 31 and extend laterally outward and downwardly therefrom in opposed relation and their lower ends are secured to the bottom wall 14. The panels 35 extend angularly across the access openings 17 in the back wall 11 and serve as dispensing ramps, as described hereinafter.

D-rings 36 are secured in spaced relation along the bottom edges of the back wall 11, front wall 12, and opposed side walls 13 at their juncture with the bottom wall 14. A generally rectangular storage pouch 37 having a back wall 38, front wall 39, opposed side walls 40 and a bottom wall 41 is removably attached by straps 42 to the bottom of the backpack 10. The straps 42 are looped through the D-rings 36 and are releasably secured by mating hook and loop fasteners 43 on the straps. The pouch 37 is formed of a suitable flexible fabric such as nylon or canvas and is used for storing empty containers, packaging or wrapping materials, or other articles.

Figure 6:
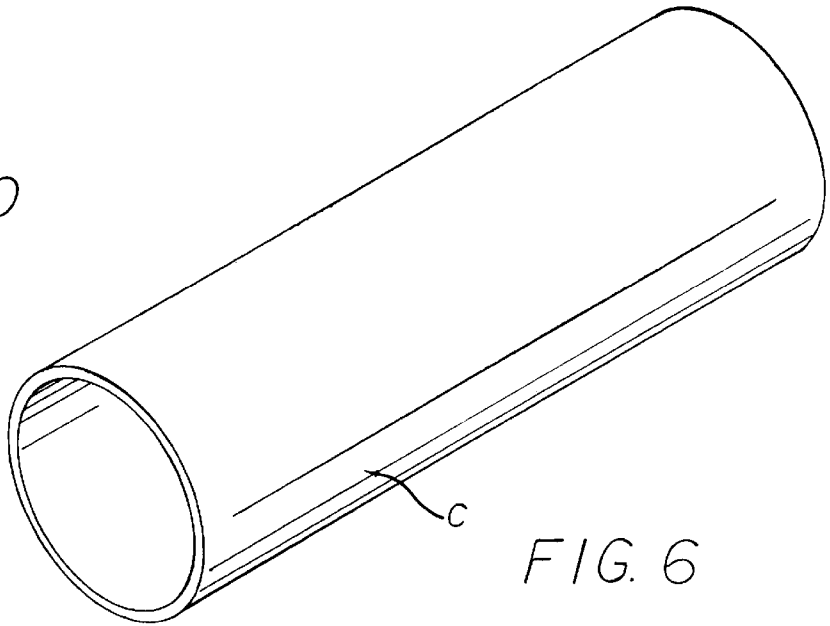
FIG. 6 is a perspective view of a cylindrical package which may be used to hold various soft or irregular shaped goods, such as pre-wrapped hot dogs in buns, tee shirts, sun glasses, etc.

The right and left compartments 32R and 32L are sized to hold a plurality of generally cylindrical containers C (FIG. 6) which may be stacked in columns and rows, as shown in dotted line in FIG. 4. Various types of products may be contained in the containers C. For example, the containers may contain a food product such as a hot dog in a bun, peanuts, popcorn, etc., or the containers may contain soft or irregular shaped merchandise such as a rolled-up T-shirt, or sunglasses, etc. The containers C may be formed of various materials such as polystyrene, thin plastic, cardboard, or any other suitable material and may be insulated or un-insulated, depending upon the type of product or merchandise to be contained. They may also be provided with end closures. It should be understood that other generally cylindrical goods may be stacked in the compartments, such as beverage cans or bottles, etc.

A pair of rectangular spacers 44 may also be installed in the compartments 32R and 32L to adapt the compartments to receive containers of different size. The spacers 44 are formed of a rectangular pad of elastomeric material covered by a suitable fabric and may be releasably fastened to extend vertically along the interior of the back wall 11 by mating hook and loop fasteners 45 installed on the interior of the back wall 11 and exterior of the spacers 44.

The containers C are stacked in columns and rows, as shown in dotted line in FIG. 4, and the lowermost row of containers are supported on the dispensing panels 35, with the outermost container CL in alignment with the corresponding access opening 17, but held in place by the elastic strap 18. The vendor reaches rearwardly with his right or left hand, and moving the elastic strap aside, reaches through the access opening 17 and pulls the outermost container out of the backpack.

The lateral spacing of the D-rings 36 and straps 42 is such that a small space 46 is provided between the open top end of the flexible storage pouch 37 and the bottom wall 14 of the backpack 10. Empty containers, papers, or other articles may be pushed through the space 46 into the storage pouch 37 without unfastening the straps 42. After the storage pouch 37 is full of empty containers or other articles, the pouch can be removed and emptied by unfastening the straps 42. The storage pouch 37 may also be used to hold condiments or packages of condiments.

Figure 7:
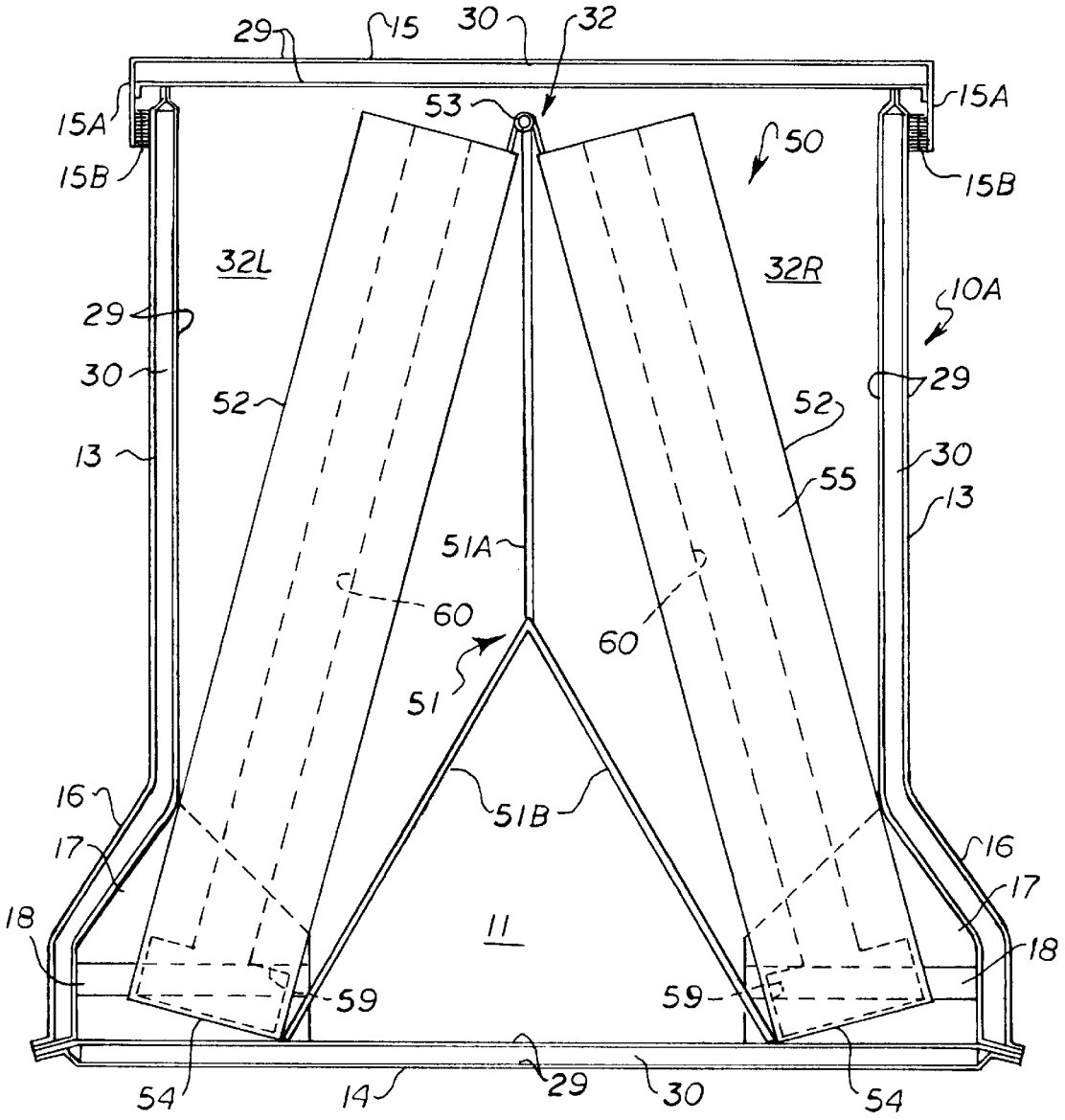
FIG. 7 is a longitudinal cross section through a modification of backpack similar to FIG. 4, showing the interior of the backpack having a removable receptacle installed therein.
Figure 8:
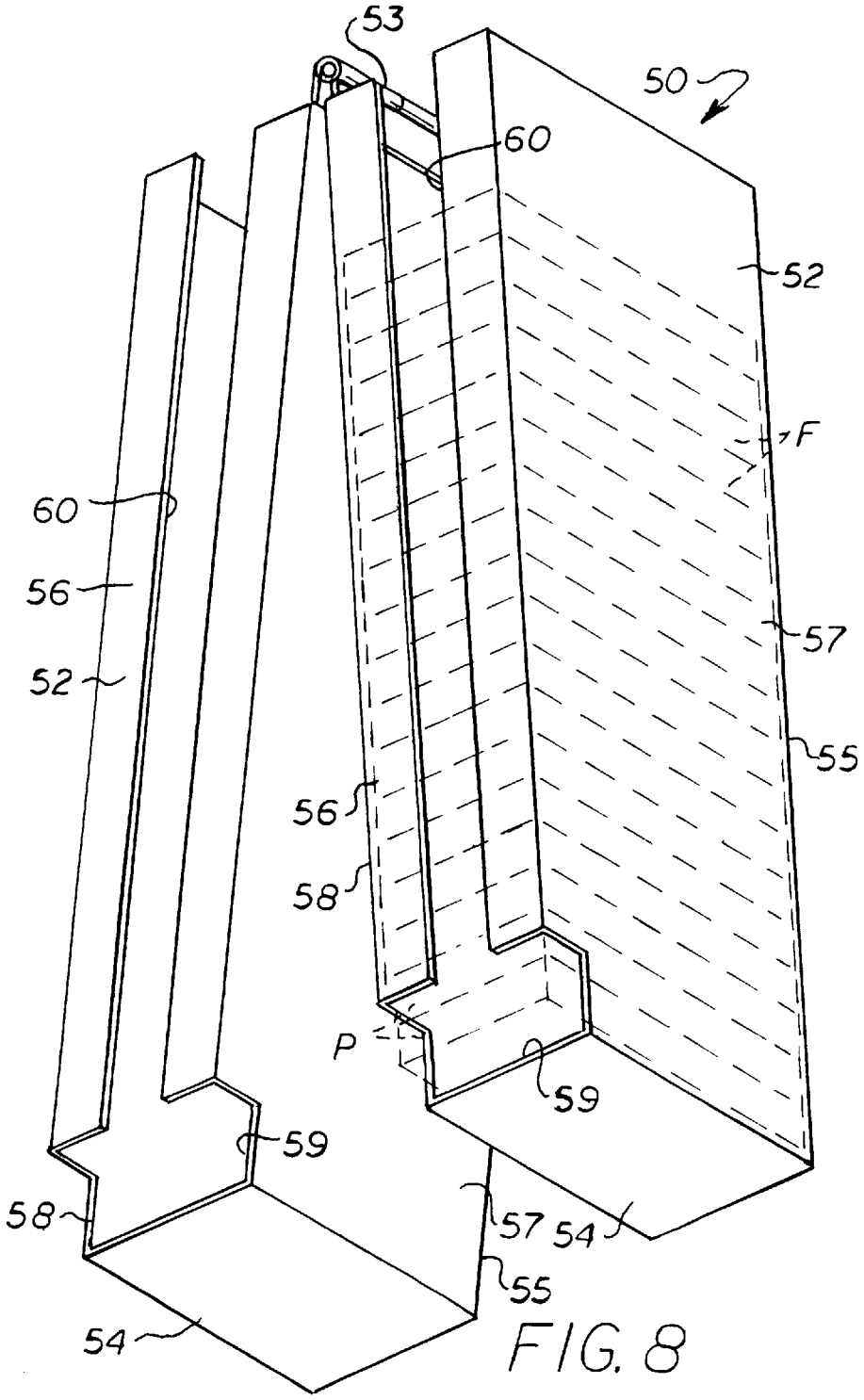
FIG. 8 is a perspective view of a removable receptacle which may be pre-loaded with various semi-rigid or generally pologonal shaped goods, such as packages of peanuts, packages of film, packages of cigarettes, etc.

FIG. 7 is a longitudinal cross section through an embodiment of the backpack 10A similar to FIG. 4 wherein the interior of the backpack receives a removable magazine or receptacle 50. As seen in FIG. 8, the removable receptacle 50 is pre-loaded with various semi-rigid or generally polygonal shaped goods P, such as packages of peanuts, packages of film, packages of cigarettes, etc. which are stacked in a column, shown in dashed line in FIG. 8. It should be understood, that the removable receptacle 50 may also be preloaded with generally cylindrical containers, such as described previously, or with beverage cans or bottles, etc. In this embodiment an inverted Y-shaped dispensing ramp 51 is disposed at the bottom of the central compartment 32. The dispensing ramp 51 may be formed of rigid or semi-rigid material and has a vertically extending rectangular divider 51A with a pair of generally rectangular panels 51B at its lower end which extend laterally outward and downwardly therefrom in opposed relation and their lower ends are engaged on the bottom wall 14 adjacent to the access openings 17 in the back wall 11. The vertically extending rectangular divider 31A is disposed perpendicular to the front and back walls 12 and 11, respectively, of the backpack to divide the interior compartment 32 into right and left compartments 32R and 32L.

The removable receptacle 51 comprises a pair of hollow generally rectangular members 52 joined at their upper ends by a hinge 53. Each rectangular member 52 has a bottom wall 54, opposed front and rear walls 55 and 56, and opposed side walls 57 and 58, respectively. The juncture of the bottom wall 54 and rear wall 56 is cut out to define a rectangular opening 59 of sufficient size to expose one end of the lowermost one of the packaged goods P. The rear wall 56 may also be provided with a longitudinally extending slot or opening 60 to facilitate viewing or manually manipulating the stacked packaged goods.

The removable receptacle 50 is installed in the backpack 10A by orienting the rear walls 56 of the rectangular members 52 to face the rear wall 11 of the backpack, placing the rectangular members on respective opposed sides of the vertical divider 51A and lowering it downwardly. As the receptacle 50 is lowered, the bottom ends of the rectangular members 52 engage the panels 51B and slide outwardly in laterally opposed relation. In the installed position, the openings 59 at the bottom of the rectangular members 52 are disposed adjacent the access openings 17 in the rear wall 11 of the backpack. The vendor reaches rearwardly with his right or left hand, and moving the elastic strap 18 aside, reaches through the access opening 17, grips the exposed end of the lowermost one of the packaged goods P in one of the rectangular members 52, and pulls it out of the backpack.

Figure 10:
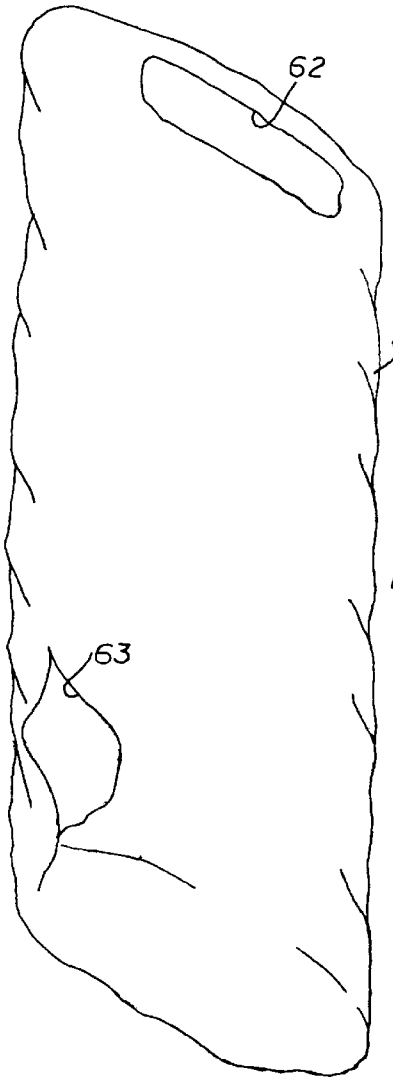
FIG. 10 is a perspective view of a disposable receptacle which may be pre-loaded with various goods and then cooled or heated as a unit prior to installing the filled receptacle in the backpack.
Figure 9:
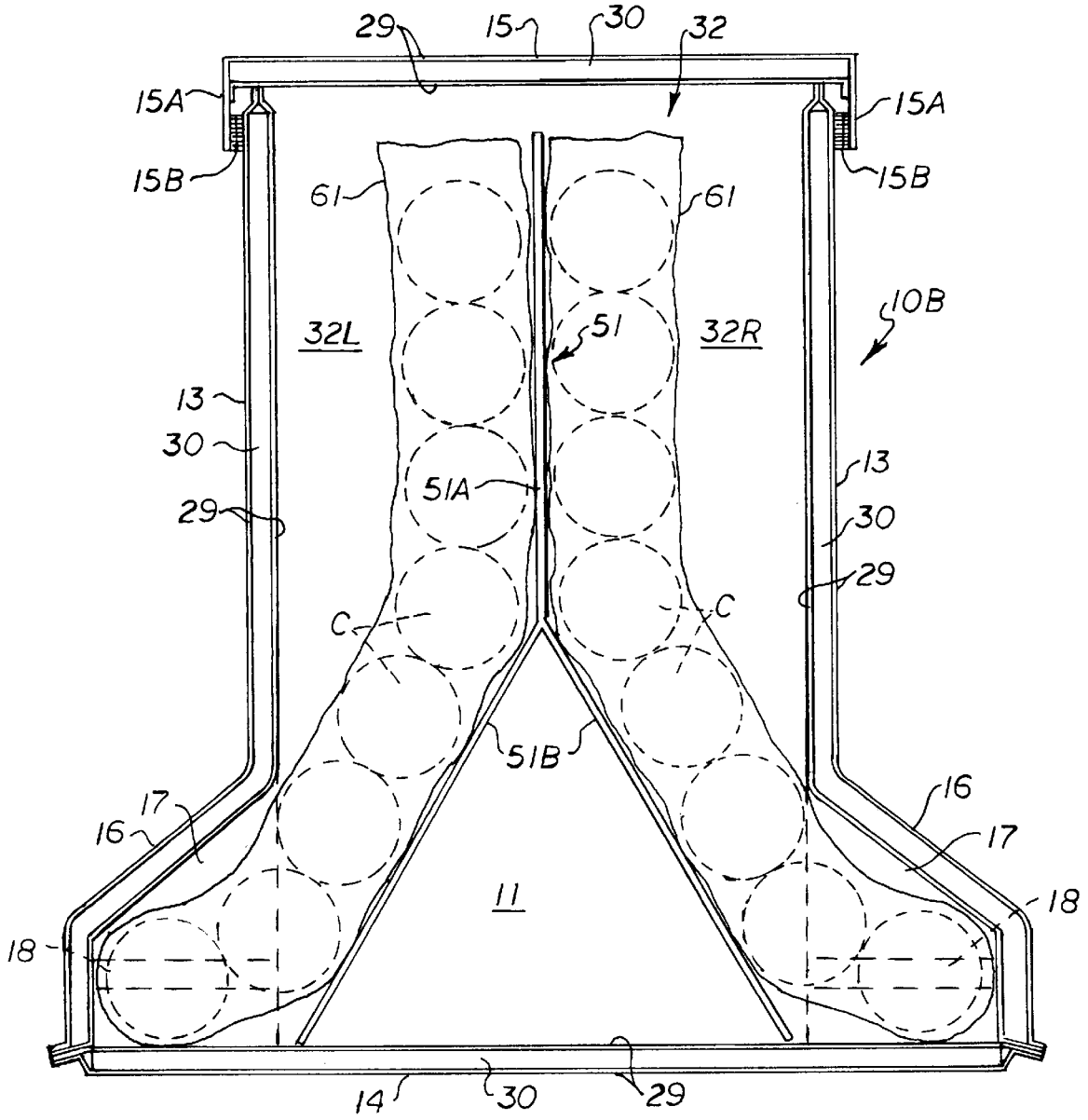
FIG. 9 is a longitudinal cross section through the backpack similar to FIG. 7, showing the interior of the backpack having a disposable receptacle installed therein.

FIG. 9 is a longitudinal cross section through an embodiment of the backpack 10B similar to FIG. 7 having the previously described inverted Y-shaped dispensing ramp 51 in the central compartment 32. In this embodiment, a disposable flexible or semi-flexible receptacle 61 is placed into the interior of the backpack. As seen in FIG. 10, the disposable flexible receptacle 61 is in the form of a sock-like bag or sack, formed of a plastic film, having side walls and a closed bottom end and may have handles 62 formed in its top end, similar to plastic bags used for groceries. Alternatively, the disposable receptacle 61 may be formed of an open mesh or foraminous plastic material such as the type used for packaging fruits and vegetables. In a preferred embodiment, the flexible receptacle 61 is sized to closely surround the containers or packaged goods being dispensed, but to not to obstruct their sliding movement.

The flexible receptacle 61 is pre-loaded with various goods stacked in a column, such as the generaly cylindrical containers C described previously, or with beverage cans or bottles, etc. The flexible receptacle 61 is particularly useful for containing goods which require refrigeration or heating. For example, the flexible receptacle 61 preloaded with cans or bottles of a beverage, or fruits, may be stored on ice or refrigerated as a single unit and placed in the backpack just prior to vending.

The disposable flexible receptacles 61 containing the goods are installed in the backpack 10B simply by lowering each one downwardly on respective opposed sides of the vertical divider 51A. As the flexible receptacles 61 are lowered, their bottom ends engage the panels 51B and slide outwardly in laterally opposed relation. In the installed position, the bottom portion of the flexible receptacles 61 are disposed adjacent the access openings 17 in the rear wall 11 of the backpack. After installation and prior to the dispensing operation, an opening 63 is formed in the side wall of the flexible receptacles 61, by reaching through the access openings 17 in the rear wall of the backpack and tearing or cutting the exposed side wall of the receptacle to form the opening 63. After the opening is formed, the vendor reaches rearwardly with his right or left hand, and moving the elastic strap 18 aside, reaches through the access opening 17, grips the exposed end of the lowermost one of the packaged goods in one of the receptacles 61, and pulls it out of the backpack.

It should be understood that the disposable flexible receptacles may also be used in the embodiment of the backpack illustrated in FIGS. 1–5.

Referring again to FIG. 1, a plurality of snap fasteners 47 may be provided on the exterior of the backpack 10, and a plurality of rectangular panels 48 having mating snap fasteners 49 thereon may be releasably attached to the exterior of the walls of the backpack. The rectangular panels 48 are imprinted with pictures or other advertising indicia to represent the type of product contained within the vendor's backpack.

Figure 11:
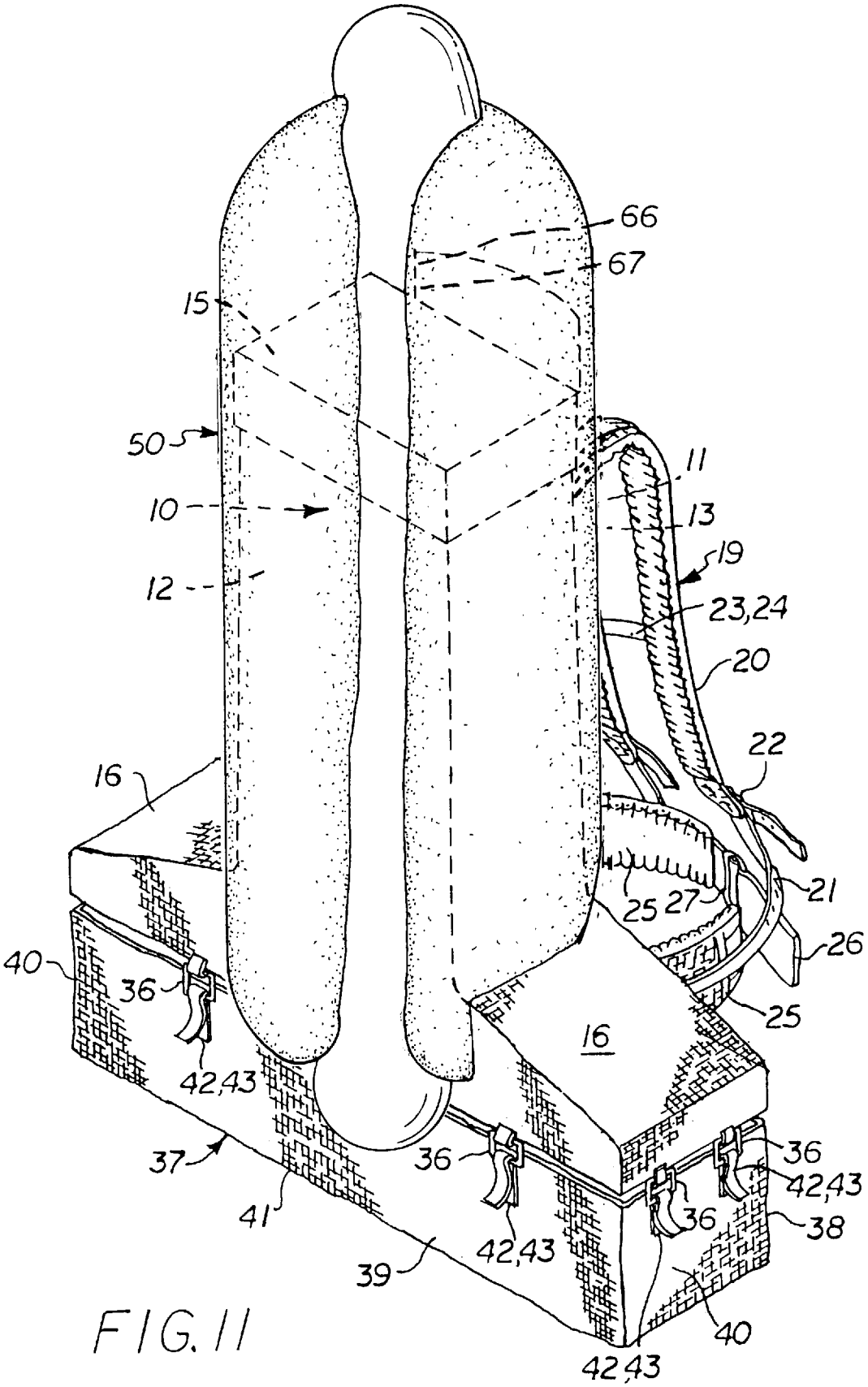
FIG. 11 is a perspective view of the backpack with a hollow shell installed on the exterior of the backpack.

Alternatively, as shown in FIG. 11, a hollow shell 65 formed into the shape of the type of product that is contained in the backpack 10 may be installed over the backpack to identify the goods carried by the vendor. For example, a hot dog in a bun. The hollow shell 65 has a slot or opening 66 in its side wall 67 to allow the shoulder harness 19 to extend therethrough.

While this invention has been described fully and completely with special emphasis upon preferred embodiments, it should be understood that within the scope of the appended claims the invention may be practiced otherwise than as specifically described herein.

I claim:

1. A backpack to be worn on the back of a person for transporting and dispensing packaged goods comprising:

a backpack having an adjustable shoulder harness adapted to receive two shoulders of a person and having a back wall, front wall, opposed side walls, and a bottom wall defining a generally rectangular storage compartment configured to hold a plurality of packaged goods in a vertically descendable disposition;

an opening at a top end of said backpack for placing a plurality of said packaged goods into said storage compartment;

at least one access opening disposed at a lower end of said backpack through which a lowermost one of said packaged goods may pass; and support means in said storage compartment having a lower portion extending laterally outward said storage compartment disposed adjacent to said at least one access opening and configured to support a lowermost one of said packaged goods in a position accessible to a hand of the person wearing said backpack for the manual removal of said lowermost one of said packaged goods.

2. The backpack according to claim 1 further comprising retaining means secured across said at least one access opening to prevent accidental passage of said lowermost one of said packaged goods through said at least one access opening.

3. The backpack according to claim 1 wherein said support means comprises an inclined support member having an upper end in said storage compartment and its said lower portion extending angularly downward and laterally outward from a side of said storage compartment for supporting a plurality of said packaged goods in a vertically descendable disposition with a lowermost one of said packaged goods positioned laterally outward from said storage compartment adjacent said at least one access opening.

4. The backpack according to claim 1 wherein said support means comprises a support member in said backpack having an inclined bottom portion extending angularly downward and laterally outward; and a receptacle received in said storage compartment having a lower portion urged laterally outward relative to said storage compartment by said support member bottom portion;

said receptacle sized and shaped to hold and releasably support a plurality of said packaged goods in a vertically descendable disposition with a lowermost one of said packaged goods positioned laterally outward relative to said storage compartment and adjacent to said at least one access opening.

5. The backpack according to claim 4 wherein said receptacle is a hollow generally rectangular member having front and rear walls and opposed side walls and a bottom wall with an opening in said rear wall through which one of said packaged goods may pass, said opening disposed adjacent to said at least one access opening.

6. The backpack according to claim 4 wherein said receptacle is a flexible bag-like member having an enclosed bottom end and opposed side walls;

said bag-like member capable of having an opening formed in one of said side walls after being installed in said storage compartment.

7. The backpack according to claim 1 wherein said backpack has a lower portion which extends laterally outward and downward from said opposed side walls to define laterally opposed outer side portions; and said back wall has a pair of laterally opposed access openings one in each said outer portion accessible to either hand of the person wearing said backpack by reaching rearwardly to manually remove a lowermost one of said packaged goods from said storage compartment.

8. The backpack according to claim 7 wherein said backpack has a pair of laterally adjacent generally rectangular storage compartments separated by a vertical divider panel extending between said front and back walls;

each of said pair of generally rectangular storage compartments is configured to hold a plurality of said packaged goods in a vertically descendable disposition; and said at least one access opening comprises a pair of laterally spaced access openings each disposed at a lower end of said backpack laterally outward from one side of each said storage compartment;

said support means comprises a pair of laterally opposed support members disposed at a lower end of said backpack configured to support a pair of lowermost packaged goods adjacent a respective said access opening each in a position laterally outward from said one side of each of said storage compartments in a position accessible to either hand of the person wearing said backpack for the manual removal of a selected one of said lowermost packaged goods from either one of said pair of storage compartments.

9. The backpack according to claim 8 wherein said backpack lower end has a lower portion which extends laterally outward and downward from said opposed side walls to define laterally opposed outer side portions; and each of said access openings comprises an opening in said back wall of said outer side portions.

10. The backpack according to claim 9 wherein said support means comprises a support member in said backpack having an inverted V-shape; and a pair of receptacles each received in a respective one of said storage compartments and each having a lower portion urged laterally outward relative to said respective storage compartment by said support member;

said receptacle sized and shaped to hold and releasably support a plurality of said packaged goods in a vertically descendable disposition with a lowermost one of said packaged goods positioned laterally outward relative said respective storage compartment and adjacent to a said access opening.

11. The backpack according to claim 10 wherein each said receptacle is a hollow generally rectangular member having front and rear walls and opposed side walls and a bottom wall with an opening in said rear wall through which one of said packaged goods may pass, said opening disposed adjacent to a said access opening.

12. The backpack according to claim 11 wherein each said receptacle is a flexible bag-like member having an enclosed bottom end and opposed side walls;

each said bag-like member capable of having an opening formed in one of said side walls after being installed in said storage compartment.

13. The backpack according to claim 1 further comprising a generally rectangular storage pouch releasably connected to said backpack bottom wall for receiving and transporting articles.

14. The backpack according to claim 13 wherein said storage pouch is a generally rectangular pouch having an open top end releasably connected to said bottom wall in spaced relation to provide a space therebetween through which articles may be passed and stored in said pouch.

15. The backpack according to claim 1 wherein said back wall, front wall, opposed side walls, and bottom wall of said backpack are thermally insulated.

16. The backpack according to claim 1 further comprising:

fastener means on an exterior surface of said backpack; and at least one panel having mating fastener means thereon for releasably attaching said panel to the exterior of said backpack;

said at least one panel imprinted with pictures or other advertising indicia to represent the type of product contained within said backpack.

17. The backpack according to claim 1 further comprising a hollow shell adapted to be received on the exterior of said backpack;

said hollow shell configured to resemble the shape of the type of goods contained within said backpack.

* * * * *